US005174318A

United States Patent [19]

Dingler et al.

[11] Patent Number: 5,174,318

[45] Date of Patent: Dec. 29, 1992

[54] MOTOR MOUNT FOR DOMESTIC DISHWASHER

[75] Inventors: Geoffrey L. Dingler; Wilbur W. Jarvis, both of St. Joseph Township, Berrien County, Mich.

[73] Assignee: Whirlpool Corporation, Benton Harbor, Mich.

[21] Appl. No.: 703,443

[22] Filed: May 20, 1991

[51] Int. Cl.[5] ..... B08B 13/00

[52] U.S. Cl. ..... 134/188; 134/201; 417/363

[58] Field of Search ..... 134/176, 179, 188, 181, 134/56 D, 57 D, 58 D, 111, 174, 201

[56] References Cited

U.S. PATENT DOCUMENTS

| | | | |
|---|---|---|---|
| 2,433,156 | 12/1947 | Pezzillo | 417/363 |
| 2,880,740 | 4/1959 | Peglow | 134/188 |
| 2,954,791 | 10/1960 | Andrews | 134/188 X |
| 3,242,871 | 3/1966 | Mercer | 417/363 |
| 3,407,747 | 10/1968 | Rule | 103/218 |
| 3,446,155 | 5/1969 | Guth | 103/218 |
| 3,500,754 | 3/1970 | Boes et al. | 103/87 |
| 3,801,229 | 4/1974 | Henderson | 417/363 X |
| 4,076,197 | 2/1978 | Dochterman | 248/15 |
| 4,200,257 | 4/1980 | Litch, III | 248/604 |
| 4,221,547 | 9/1980 | Hoffman et al. | 417/363 |
| 4,460,105 | 2/1987 | Kushner et al. | 68/23.3 |
| 4,568,243 | 2/1986 | Schubert et al. | 415/213 |
| 4,636,673 | 1/1987 | McDonald | 310/91 |
| 4,722,674 | 2/1988 | Adams et al. | 417/363 |
| 4,822,241 | 4/1989 | Jarvis et al. | 415/132 |

FOREIGN PATENT DOCUMENTS

| | | | |
|---|---|---|---|
| 870599 | 3/1953 | Fed. Rep. of Germany | 417/363 |

OTHER PUBLICATIONS

P. 1: Emerson Electric Co. Intra-Co. Correspondence from D. Bolton & W. Page re "E-Band/E-Mount Limitations", dated Feb. 8, 1989.

Pp. 2-3: Catalog pages of "Accessories" for use w/Emerson motors, includes list. & tech. specs for E-Band kit Nos. 43 and 47 on p. 3.

*Primary Examiner*—Frankie L. Stinson

*Attorney, Agent, or Firm*—Thomas J. Roth; Stephen D. Krefman; Thomas E. Turcotte

[57] ABSTRACT

A motor mount is provided for a dishwasher for preventing transmission of vibration generated by a motor through a pump to the dishwasher tub. The motor mount is secured at its base to the pump and includes a plurality of arms extending radially from the base for mounting the motor thereto. The arms are separate along their length from the pump, and are torsionally resilient, permitting the motor to vibrate torsionally with respect to the pump. The arms are radially and axially rigid, thereby preventing radial or axial motion of the motor.

12 Claims, 2 Drawing Sheets

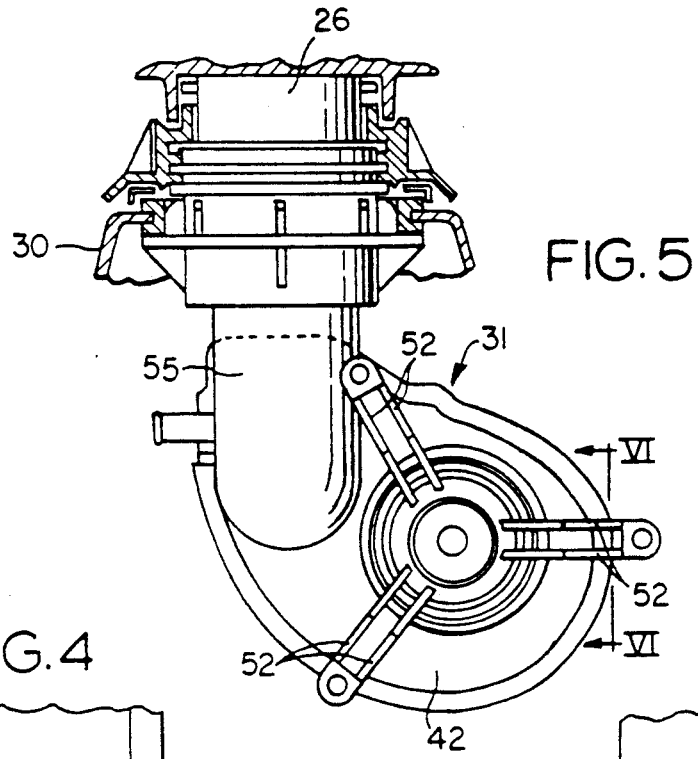
FIG. 5
FIG. 4
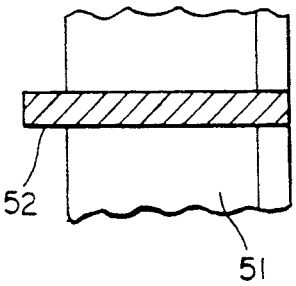
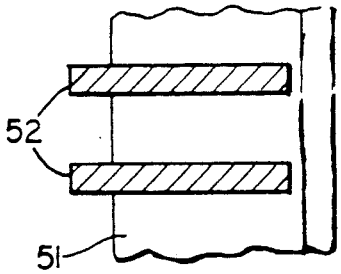
FIG. 6
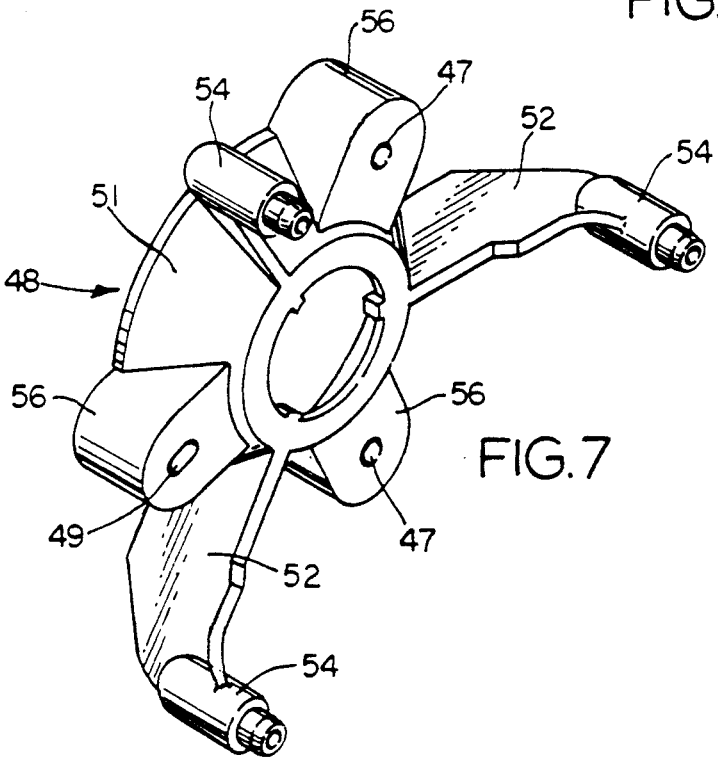
FIG. 7

MOTOR MOUNT FOR DOMESTIC DISHWASHER

BACKGROUND OF THE INVENTION

1. Field of the Invention

The present invention is directed to a motor mount for a dishwasher and particularly to a motor mount for mounting a motor to a pump in a dishwasher in order to prevent transmission of vibration and noise from the motor.

2. Description of the Prior Art

The use of motor-driven rotary shafts in combination with fluid pumps is well known. A motor is typically mounted in a fixed location relative to a pump, either to the pump itself or to structure which is also fixed relative to the pump.

A problem associated with such designs is that vibration created by an electric motor, normally occurring at twice the electrical line frequency, is transmitted to the pump, and causes the pump to vibrate at the same frequency. A typical electrical line frequency is 60 Hz, which results in a relatively low transmitted vibration frequency of 120 Hz.

In an application for a pump such as a dishwasher, where the pump is mounted to a tub having relatively large rigid walls subject to resonance, a high amount of low frequency vibration is transmitted from the pump, causing the tub to resonate and creating an unacceptable noise level. Such low frequency vibration is difficult to absorb using conventional noise absorbing or insulating materials.

In U.S. Pat. No. 3,500,754, Boes et al., an electric motor is end-mounted on a horizontal centrifugal pump. The casing of the electric motor is connected to the pump housing by screws which pass through vibration-absorbing and heat insulating bushings.

U.S. Pat. No. 2,880,740, Peglow, shows a means for preventing transmission of vibration in a dishwasher in which vibration damping material is disposed between the motor-pump combination and the dishwasher tub. An elastomeric ring is provided, having an upper annular portion connected to the bottom wall of the tub and a lower annular portion connected to the motor-pump combination. Tension is maintained on the elastomeric ring to suppress transmission of vibration to the dishwasher tub.

U.S. Pat. No. 3,446,155, Guth, shows shock-absorbing means for mounting a motorized pump assembly to the shouldered sump opening of an automatic dishwasher, comprising a flexible, generally planar solid ring-like boot. The boot provides both vibration dampening and water sealing functions.

In U.S. Pat. No. 4,822,241, Jarvis et al., assigned to the assignee of the present patent application, an automatic dishwasher includes an electric motor end-mounted to a pump housing in a horizontal configuration, with the motor being rigidly supported at three support points.

Therefore, it is known to isolate vibration in a motor-pump combination by providing flexible boots and bushings. A disadvantage of such vibration isolation systems, however, is the inability to permit torsional motion of the motor, while preventing undesirable radial motion of the motor. Another disadvantage of known vibration isolation systems is the requirement of soft, resilient members subject to degradation over use and time.

Another disadvantage of known vibration isolation systems is the inability to permit torsional motion of the motor, while preventing undesirable axial travel of the motor. Yet a further disadvantage of known vibration isolation systems is the inability to, in a cost-efficient manner, end-mount a motor in a dishwasher while preventing transmission of unwanted vibration to the dishwasher tub.

SUMMARY OF THE INVENTION

The present invention relates to a motor-driven rotary pump assembly which includes a pump housing, a drive shaft extending into the housing, and a seal between the shaft and housing. A motor mount having a plurality of motor support arms formed of relatively rigid material is removably secured to the pump housing.

The invention overcomes those problems found in prior art motor mounts by providing a torsional vibration isolation system which prevents transmission of vibration generated by an electric motor, which generally occurs at twice the electrical line frequency, from being transmitted through the pump assembly to which the electric motor is mounted and to a dishwasher tub.

Another object of the invention is to provide a torsional vibration isolation system for a motor-pump combination which permits torsional motion of the motor, while preventing undesirable radial motion of the motor. It is another object of the invention to provide a torsional vibration isolation system which permits torsional motion of the motor, while preventing axial travel of the motor.

It is a further object of the invention to provide a torsional vibration isolation system which eliminates the requirement of soft, resilient members which are subject to degradation over use and time. Yet a further object of the invention is to provide a torsional vibration isolation system which permits, in a cost-efficient manner, end-mounting a motor in a dishwasher while preventing transmission of unwanted vibration to the dishwasher tub.

In attainment of the foregoing objects, a preferred embodiment of this invention contemplates a pump assembly including a motor with a rotary drive shaft. The drive shaft extends through an aperture in a pump housing into a pump chamber. An impeller mounted on the drive shaft operates within the pump chamber to pump wash fluid to a spray arm. The motor is mounted onto the pump housing by means of a motor mount intermediate and separable from the motor and pump housing. The motor mount includes a plurality of relatively rigid motor support arms extending radially from the drive shaft axis, which arms are spaced from the motor and the pump housing. Accordingly, torsional vibration generated by the motor is dampened by the motor support arms, preventing transmission of undesired vibration to the pump housing, while maintaining the motor in a constant axial and radial relationship with the pump housing.

These and other objects and advantages of the present invention will become apparent upon reference to the accompanying description when taken in conjunction with the following drawings.

BRIEF DESCRIPTION OF THE DRAWINGS

FIG. 4 is an enlarged sectional view taken through line IV—IV of FIG. 2.

FIG. 5 is a front elevational view of a pump incorporating an alternative embodiment of the motor mount.

FIG. 6 is an enlarged sectional view taken through line VI—VI of FIG. 5.

FIG. 7 is an isometric view of the preferred embodiment of the motor mount.

DESCRIPTION OF THE PREFERRED EMBODIMENTS

Figure 1:
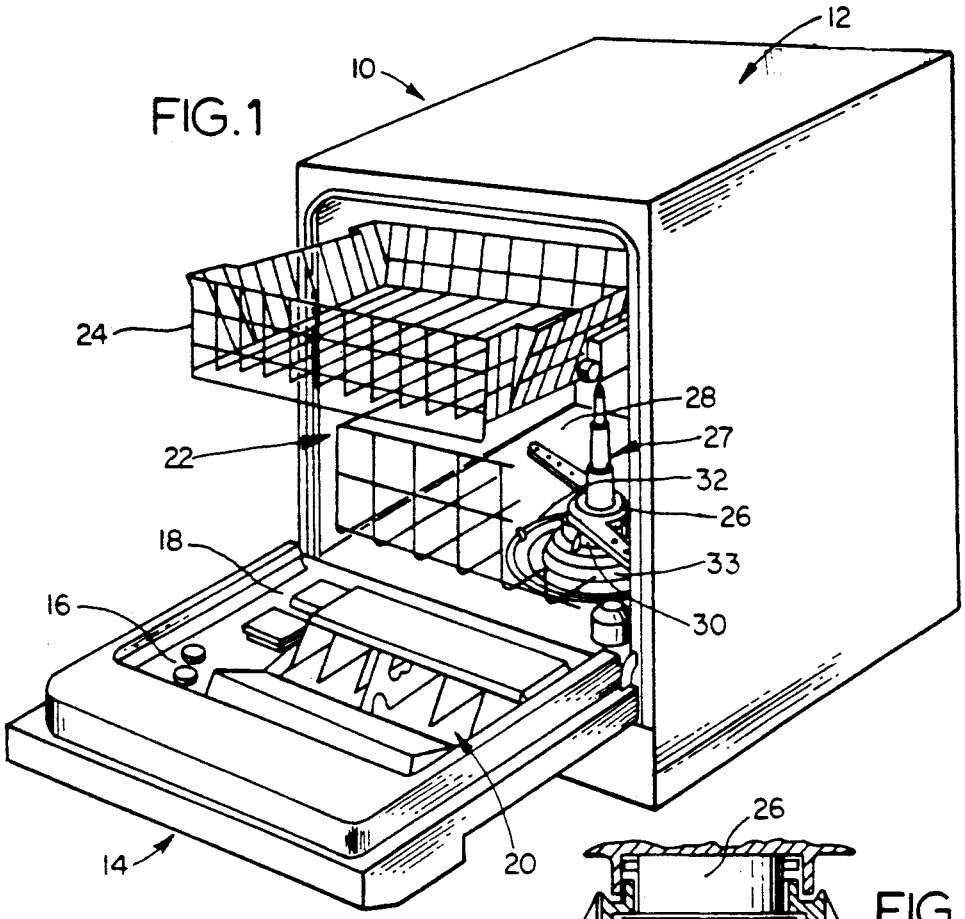
FIG. 1 is a perspective view of a dishwasher including a pump incorporating the motor mount of the present invention.

As set forth hereinabove, the present invention is particularly advantageous when employed in an automatic dishwasher, although the invention is not limited to use in such an environment. However, in order to disclose a preferred embodiment of the invention, such an environment has been selected as an example. FIG. 1 shows such a dishwasher 10 having a cabinet 12 and a door 14. The interior of the door carries a rinse additive dispenser 16. a detergent dispenser 18, and utensil basket 20, which receives silverware and other small objects to be washed. A wash chamber 2 of the cabinet 12 houses dish supporting racks 24 and a rotating spray device 26, including collapsible towers 27. Adjacent the floor 28 of the wash chamber 22 is a raised area 30 which houses a pump assembly 31. A heating element 32 is disposed in a sump area 33 surrounding the rotating spray device 26 for heating the wash liquid to a temperature between 120 and 160 degrees F.

Figure 2:
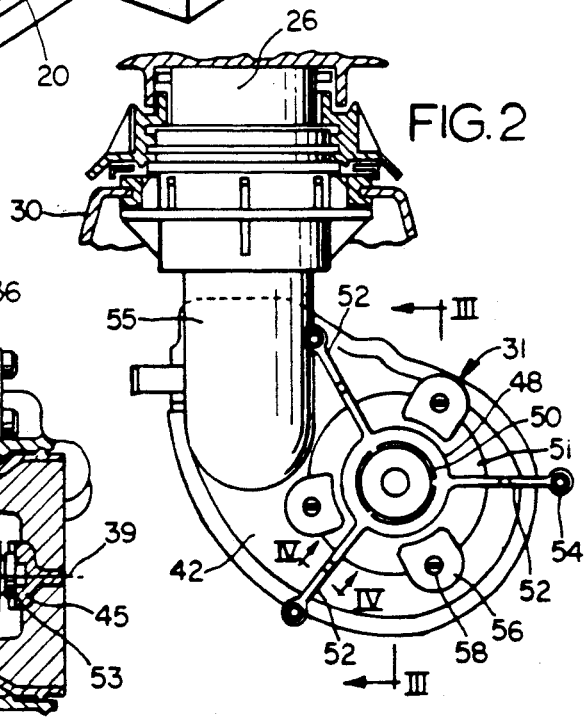
FIG. 2 is a front elevational view of a pump incorporating the motor mount.
Figure 3:
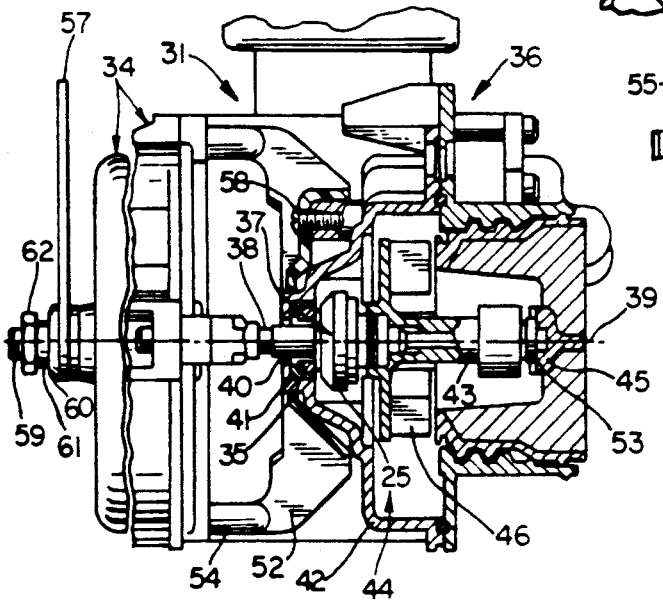
FIG. 3 is a side elevational view of a motor mounted to a pump incorporating the motor mount, the motor mount being shown in partial section along line III—III in FIG. 2.

As shown in FIGS. 2 and 3, the pump assembly 31 includes a motor 34 and pump 36 for delivering wash liquid (not shown) to rotating spray device 26 for distribution within wash chamber 22. A drive shaft 38 of the motor 34 extends along drive shaft axis 39 into the pump housing through the aperture 40. A seal 37 is provided to prevent significant leakage of fluid through the aperture 40. The seal includes an annular stationary part 35, preferably formed from a ceramic material, affixed by a grommet 41 to the pump housing 42, and an annular rotating part 25, preferably formed from a phenolic material, affixed to and rotating with the drive shaft 38. The respective seal parts form a substantially fluid-tight barrier, preventing leakage of fluid from pump 36.

Impeller 46 is located in pump chamber 44 for providing pressurized wash fluid to rotating spray device 26. Impeller 46 includes impeller shaft 43 which is journalled into thrust bearing 53. Thrust bearing 53 is retained in pump housing 42 by bearing disk 45 in a conventional manner.

Located exteriorly of the pump housing 42 and mounted concentrically about the hub 50 of pump housing 42 is motor mount 48. Motor mount 48 is preferably formed of a thermoplastic resin material, such as polyphenyl oxide. Three hub fasteners 58 extend through three hub mounts 56, respectively, which are preferably spaced approximately 120 degrees apart on motor mount base 51. The hub mounts 56 may vary from an even spacing with respect to each other as required to accommodate the motor support arms, 52, as later herein described, and to accommodate the shape of the pump housing 42.

Hub fasteners 58 may comprise flat head screws as shown, or other appropriate threaded fasteners as is well known. Two of the three hub mounts each contains a generally cylindrical through hole 47 through which a hub fastener 58 extends. A third hub mount contains an oblong through hole 49 through which a hub fastener extends, to compensate for any drift from specifications of the alignment of the tapped motor mount mounting holes in pump housing 42. Each hub fastener 58 secures motor mount 48 to pump housing 42.

Three motor support arms 52 extend from the motor mount base and are disposed between hub mounts 56. Each motor support arm 52 extends in both radial and axial directions from motor mount base 51, so that when motor mount 48 is secured to pump housing 42, each arm is spaced throughout its length from pump housing 42. Each motor support arm 52 terminates in a boss 54 for mounting the motor 34 to the motor mount 48. The motor support arms 52 are preferably spaced approximately 120 degrees apart, or as required to align each boss 54 with its respective mounting hole located on the motor (not shown) while avoiding interference with pump outlet 55. Preferably, the motor support arms 52 are also located on motor mount base 51 such that, when motor 34 is secured to pump housing 42, the motor electrical terminals (not shown) are advantageously positioned within the dishwasher for ease of access.

To support the end of motor 34, wire hangar 57 is provided, as is well known. End bolt 59 projects from motor 34, and is centered about drive shaft axis 39, so that torsional motion only of end bolt 59 is permitted. End nut 62 secures bushing 60 over spacer 61. Hanger 57 is partially wound around bushing 60, and is secured at its other end to dishwasher 10. Therefore, as motor 34 vibrates about drive shaft axis 39, bushing 60 is permitted to rotate freely with respect to hangar 57.

As shown in FIGS. 4 and 7, each motor support arm 52 is preferably formed in rectangular cross-section, which provides relatively low resistance to bending moments, thereby permitting each arm to flex torsionally with respect to drive shaft axis 39. An alternative embodiment of the inventive concept is shown in FIGS. 5 and 6, wherein each motor support arm 52 consists of a spaced pair of members extending parallel to one another from motor mount base 51. Other motor support arm configurations are conceivable without departing from the spirit of the invention, such as motor support arms having a v-shaped or u-shaped configuration, or having a cross-section other than rectangular, such as circular or ovular, etc., the main requirement being that the arm extend from motor mount base 51 without contacting pump housing 42. In doing so, the motor is permitted to vibrate torsionally with respect to the drive shaft axis 39, while remaining stationary in a radial or axial direction with respect to the drive shaft axis 39. Accordingly, the inventive motor mount 48 acts to dampen torsional vibration generated by motor 34, preventing the vibration from being transmitted through the pump housing 42 to the floor 28 of wash chamber 22.

As is apparent from the foregoing specification, the invention is susceptible of being embodied with various alterations and modifications which ma differ particularly from those that have been described in the preceding specification and description. It should be understood that we wish to embody within the scope of the patent warranted hereon all such modifications as reasonably and properly come within the scope of our contribution to the art.

What is claimed is:

1. A pump assembly comprising:

a pump housing having an interior wall defining a pump chamber, a motor mount projecting from said pump housing, said motor mount including a base defining an opening, said motor mount having a plurality of arms extending radially from said base, a motor removably secured to said plurality of arms, said motor including a drive shaft extending from said motor and through said opening, said arms each being separate over its length from said pump housing, wherein said drive shaft defines an axis extending through said opening in said base, said arms extending radially from said axis, whereby said motor is permitted to move torsionally with respect to said axis.

2. A pump assembly as described in claim 1, wherein said motor mount is removably secured to said pump housing.

3. A pump assembly as described in claim 1, wherein each of said arms has a proximal end secured to said base and a distal end, and having mounting means located at said distal end for mounting said motor thereto.

4. A pump assembly as described in claim 1, wherein each of said arms includes an axial extent.

5. A pump assembly as described in claim 4, wherein each of said arms includes a rectangular cross-section.

6. A pump assembly as described in claim 5, wherein the length of said rectangular cross-section extends parallel to said hub axis.

7. A pump assembly as described in claim 1, wherein said arms are flexible along their length, whereby torsional movement of said motor is permitted while axial movement of said motor is prevented.

8. A pump assembly as described in claim 1, wherein said arms are flexible along their length, whereby torsional movement of said motor is permitted while radial movement is prevented.

9. A pump for distributing wash liquid in a dishwasher, said pump defining a journal for a pump shaft and having a plurality of arms for mounting a motor to said pump, each of said arms comprising:

a first portion extending radially from said journal, said first portion having a proximal end integral to said pump and a distal end separate from said pump, a second portion integral to said first portion and projecting from said distal end of said first portion in a direction parallel to said journal for mounting said motor thereto.

10. A dishwasher comprising:

A wall defining a wash cavity, means for introducing water into said wash cavity for washing dishes placed therein, a pump having an outlet for providing pressurized water to said means for introducing water into said wash cavity, said pump further having a pump housing including an interior wall defining a pump chamber, said pump further including an impeller located in said pump chamber, a motor mount projecting from said pump housing, said motor mount including a base defining an opening, said motor mount having a plurality of arms extending radially from said base, a motor removably secured to said plurality of arms, said motor including a drive shaft extending through said opening and pump housing and having said impeller mounted thereon, said arms each being separate over its length from said pump housing, wherein said drive shaft defines an axis extending through said opening in said base, said arms extending radially from said axis, whereby said motor is permitted to move torsionally with respect to said axis.

11. A dishwasher as described in claim 10, wherein said motor mount is removably secured to said pump housing.

12. A dishwasher as described in claim 10, wherein each of said arms has a proximal end secured to said base and a distal end, and having mounting means located at said distal end for mounting said motor thereto.

* * * * *